US011305930B2

(12) United States Patent
Balestri

(10) Patent No.: US 11,305,930 B2
(45) Date of Patent: Apr. 19, 2022

(54) WIPE CONTAINER

(71) Applicant: Veltek Associates, Inc., Malvern, PA (US)

(72) Inventor: Michael Balestri, Mechanicsville, VA (US)

(73) Assignee: Veltek Associates, Inc., Malvern, PA (US)

( * ) Notice: Subject to any disclaimer, the term of this patent is extended or adjusted under 35 U.S.C. 154(b) by 211 days.

(21) Appl. No.: 16/405,567

(22) Filed: May 7, 2019

(65) Prior Publication Data

US 2019/0263579 A1 Aug. 29, 2019

Related U.S. Application Data

(63) Continuation of application No. 14/927,089, filed on Oct. 29, 2015, now Pat. No. 10,279,976.
(Continued)

(51) Int. Cl.
*B65D 81/22* (2006.01)
*B65D 25/08* (2006.01)
(Continued)

(52) U.S. Cl.
CPC ..... *B65D 81/22* (2013.01); *B65D 25/08* (2013.01); *B65D 81/3205* (2013.01); *A47K 2010/3266* (2013.01)

(58) Field of Classification Search
CPC .... B65D 81/22; B65D 81/3205; B65D 25/08; B65D 75/34; B65D 75/323; B65D 75/367; B65D 83/08; B65D 83/0847; B65D 83/0876; B65D 83/0805; A47K 2010/3266; A47K 2010/3273; B67C 7/0073; B65B 25/14; B65B 25/145; B65B 61/20; B65B 2220/14; B65B 2230/02
(Continued)

(56) References Cited

U.S. PATENT DOCUMENTS 2,440,974 A * 5/1948 Resch ..... A47K 10/32 312/31
2,967,610 A 1/1961 Ebert et al.
(Continued)

FOREIGN PATENT DOCUMENTS

WO WO2005/108543 * 11/2005 ..... A47L 1/15

OTHER PUBLICATIONS

"Steri-Perox® Wipe", Overview, Veltek Associates, Inc., Mar. 2010; 4 pages.

(Continued)

*Primary Examiner* — Robert F Long
*Assistant Examiner* — Eduardo R Ferrero
(74) *Attorney, Agent, or Firm* — Blank Rome LLP

(57) ABSTRACT

A wipe container that includes a cover member that has a cavity, at least one wipe received in the cavity of the cover member, a base member that has a fluid reservoir, and a partition that is disposed between the cover and base members. The cover member, the base member, and the partition are sealed together to create a perimeter seal. The partition creates a barrier between the wipe on one side and cleaner on the other side. The container can be introduced into a clean room. Just prior to use, the partition is split open so that the cleaner mixes with water on the wipes.

12 Claims, 6 Drawing Sheets

Related U.S. Application Data

(60) Provisional application No. 62/072,832, filed on Oct. 30, 2014.

(51) Int. Cl.
*B65D 81/32* (2006.01)
*A47K 10/32* (2006.01)

(58) Field of Classification Search
USPC ..... 53/431, 471; 221/45
See application file for complete search history.

(56) References Cited

U.S. PATENT DOCUMENTS 3,038,473 A 6/1962 Ladd
3,090,463 A 5/1963 Altree et al.
3,368,522 A * 2/1968 Cordis ..... A47K 10/422 118/43
3,775,801 A * 12/1973 Walker ..... A47K 10/3827 15/104.93
3,786,615 A * 1/1974 Bauer ..... A61F 13/00991 53/429
3,841,466 A * 10/1974 Hoffman ..... B65D 43/164 206/205
3,889,804 A * 6/1975 Ravich ..... B65D 81/3261 206/221
4,332,319 A 6/1982 Hurwood
4,408,437 A * 10/1983 Crouch ..... B65B 63/00 53/111 R
4,534,308 A * 8/1985 Kretschmer ..... D06B 1/08 118/260
4,610,357 A * 9/1986 Nakamura ..... B65B 9/073 206/449
4,620,502 A * 11/1986 Kimble ..... A47K 10/32 118/419
4,667,846 A 5/1987 Marceau
4,726,471 A 2/1988 Whately et al.
4,796,751 A 1/1989 Madkour
4,844,251 A 7/1989 Gueret
4,946,033 A * 8/1990 Conner ..... B65D 81/3261 206/223
4,966,286 A 10/1990 Muckenfuhs
4,984,530 A * 1/1991 Dutton ..... A47K 10/28 118/235
4,998,671 A 3/1991 Leifheit
5,076,424 A * 12/1991 Nakamura ..... A47K 10/3818 206/205
5,152,121 A * 10/1992 Nakamura ..... A47K 10/3818 53/111 RC
5,254,109 A * 10/1993 Smith ..... A61F 15/001 401/132
5,344,007 A * 9/1994 Nakamura ..... B65D 81/22 206/205
5,616,337 A 4/1997 Kasianovitz et al.
5,814,159 A 9/1998 Paley et al.
5,865,309 A * 2/1999 Futagawa ..... A61J 1/2093 206/219
5,906,278 A 5/1999 Ponsi et al.
5,938,013 A * 8/1999 Palumbo ..... B65D 83/0805 206/210
5,961,500 A 10/1999 Weinstein
5,988,371 A 11/1999 Paley et al.
6,001,187 A 12/1999 Paley et al.
6,062,381 A 5/2000 Paley et al.
6,068,820 A * 5/2000 De Guzman ..... B65D 81/3272 422/294
6,079,562 A 6/2000 Bauer et al.
6,085,899 A * 7/2000 Thorsbakken ..... A47K 10/32 206/205
6,123,900 A 9/2000 Vellutato
6,170,426 B1 * 1/2001 Thorsbakken ..... A47K 10/32 118/43
6,315,114 B1 * 11/2001 Keck ..... A47K 10/3809 206/210
6,346,153 B1 * 2/2002 Lake ..... A47K 10/32 118/419
6,540,834 B2 * 4/2003 Chingren ..... B44C 7/02 118/419
6,639,185 B1 10/2003 McConnell et al.
6,827,080 B2 12/2004 Fish et al.
6,866,145 B2 3/2005 Richards et al.
6,978,889 B2 12/2005 McBride
7,018,473 B2 3/2006 Shadrach, III
7,063,245 B2 * 6/2006 Faulks ..... A47K 10/32 225/27
7,185,841 B2 * 3/2007 Kaufmann ..... A47K 10/32 242/564.4
7,293,738 B2 * 11/2007 Grebonval ..... A47K 10/38 242/597.7
7,357,248 B2 4/2008 Sivakumar et al.
7,374,039 B2 * 5/2008 Farmer ..... A61K 8/0208 206/229
7,681,725 B2 3/2010 Mueller et al.
7,784,424 B2 * 8/2010 Wentworth ..... G07F 9/105 118/419
7,850,041 B2 12/2010 Amundson et al.
8,006,864 B2 8/2011 Fryan et al.
8,038,000 B2 10/2011 Bonnell et al.
8,044,325 B1 10/2011 Cooper
8,833,550 B2 * 9/2014 Baschnagel ..... A61M 11/008 206/233
8,967,523 B2 * 3/2015 Huang ..... A47K 10/3827 242/588.3
9,603,495 B2 * 3/2017 Manfredonia ..... A47K 10/426
10,279,976 B2 * 5/2019 Balestri ..... B65D 81/22
10,448,793 B2 * 10/2019 Cadet ..... C11D 1/66
2002/0070130 A1 * 6/2002 Skoufis ..... C11D 3/3947 206/207
2007/0199841 A1 * 8/2007 Mesalic ..... B65D 83/0805 206/233
2008/0135570 A1 * 6/2008 Lee ..... A47K 10/422 221/36
2010/0032443 A1 2/2010 Mueller et al.
2012/0312713 A1 * 12/2012 Bando ..... B65D 75/5838 206/525
2013/0043145 A1 * 2/2013 Smith, III ..... A61K 8/0245 206/38
2014/0004227 A1 1/2014 Tran
2014/0202894 A1 7/2014 Smith et al.
2014/0216975 A1 * 8/2014 Chrysanthidis ..... B65B 11/50 206/524.6
2015/0136784 A1 * 5/2015 Bennett ..... B65D 75/5883 220/524
2015/0257613 A1 * 9/2015 Hammond ..... A47K 10/42 221/45
2016/0060019 A1 * 3/2016 Ishihara ..... B65D 75/5838 206/205
2017/0015482 A1 * 1/2017 Lewis ..... A47K 10/32

OTHER PUBLICATIONS

"Hypo-Chlor® Wipe", Overview; Veltek Associates, Inc.; Nov. 2009; 4 pages.
"Process2Wipe® IPA70", Overview; Veltek Associates, Inc.; Nov. 2010; 4 pages.
International Preliminary Report on Patentability issued in PCT/US2015/058113 dated May 2, 2015, 8 pages.

* cited by examiner

WIPE CONTAINER

RELATED APPLICATIONS

This application is a continuation of U.S. patent application Ser. No. 14/927,089, now U.S. Pat. No. 10,279,976, filed Oct. 29, 2015, which claims the benefit of U.S. Provisional Application No. 62/072,832, filed Oct. 30, 2014. The entire contents of those applications are incorporated herein by reference.

FIELD OF THE INVENTION

The present invention relates to a container for holding one or more wipes saturated with a cleaning agent and the container being suitable for dispensing the wipes in a clean room environment.

BACKGROUND OF THE INVENTION

A clean room environment is a room designed, maintained, and controlled to prevent particle and microbiological contamination from entering or residing in products that will be manufactured in the controlled environment. There are different levels of cleanliness in clean rooms, generally in the range of a ISO 5, Grade A, Class 100 room (i.e., a room having 100 particles of 0.5 micron and larger, per cubic foot of air), to a ISO 8, Grade D, Class 100,000 clean room. Clean rooms are used for a variety of purposes, including to manufacture pharmaceutical products and electronics, such as semiconductors. Clean rooms have to maintain a high level of cleanliness, or risk large financial losses. If a product being developed or manufactured in a clean room becomes contaminated, the entire product in the clean room must often be discarded.

The U.S. Food and Drug Administration ("FDA") requires firms to assure that every element of the manufacturing environment and manufacturing process are proven to be acceptable to FDA requirements and industry standards. The FDA requires firms to operate in accordance with Current Good Manufacturing Practices (CGMP). To do this, firms are required to assure that products, personnel, training, ingredients, procedures and systems used in the manufacture of a drug product have undergone stringent testing. In light of the strict standards that clean rooms must satisfy, companies are very reluctant to introduce new products into their clean rooms that have not been extensively tested and proven reliable.

It would not be acceptable if the manufacturing method resulted in a product that might contaminate a clean room. Certain chemicals are used inside a clean room to disinfect the clean room. However, some chemicals can lose effectiveness or become unstable after a short period of time (e.g., 20-30 days) once the chemical is mixed or when the chemical is saturated onto a wipe. Consequently, those chemical compositions need to be diluted just prior to use or introduced onto a wipe just prior to use. Yet, it is particularly difficult and time-consuming to dilute chemical compositions and/or to saturate a wipe inside a clean room because of possible contamination of the chemicals by the environment and because the user is outfitted in sterile garments and gloves.

Controlled or clean environments, such as hoods, clean rooms or facilities have strict requirements for cleanliness, particularly requiring surfaces to be cleaned often and on a consistent basis. Conventional packaged saturated wipes may be not sufficiently sterile for a clean room or are easily contaminated because of design of the package and/or because the chemical interacts with the structure of the wipe or other chemicals on the wipe. Also the wipes in conventional packages often deteriorate or lose the potency of the active ingredient(s) of the cleaning agent. Additionally, some cleaners are mixed with water just prior to use inside clean room, which is time-consuming and labor-intensive. Cleaners also have a short shelf life after mixing; and the exact amount of water to cleaner must be precisely measured. Many sanitizers, disinfectants and sporicides used in saturated wipes have the inability to be mixed with water for extended time periods. This stability problem relates to the degradation of the active ingredients over time in the solution and is further complicated by the presence of the wiping material, wiping material additives and air in the package.

Examples of conventional wipes containers include U.S. Pat. Nos. 8,038,000; 7,850,041; 7,681,725; 7,357,248; 6,866,145; 6,827,080; 6,001,187; 5,988,371; and 5,814,159, the subject matter of each of which is herein incorporated by reference.

Therefore, a need exists for a sterile wipe container that reduces deterioration of the wipes and associated cleaning agent.

SUMMARY OF THE INVENTION

Accordingly, the present invention may provide a wipe container that includes a cover member that has a cavity, at least one wipe received in the cavity of the cover member, a base member has a fluid reservoir, and a partition is disposed between the cover and base members, wherein the cover member, the base member, and the partition are sealed together to create a perimeter seal.

The present invention also may a wipe container configured and suitable for use in a clean room that comprises, a cover member that has a cavity, at least one wipe received in the cavity, a base member that has a fluid reservoir and at least one puncture member, and a partition disposed between the cover and base members. The partition is formed of a membrane that can be split open by the at least one puncture member of the base member. At least one fill port is in fluid communication with the fluid reservoir. Wherein the cover and the base members are sealed together to create a perimeter seal and the at least one fill port is disposed in the perimeter seal.

The present invention may further provide a method of loading a wipe container that comprises the steps of providing a container that has a cover member and a base member; loading at least one wipe into a cavity of the cover member of the container; sealing a partition between the cover and base members of the container creating a seal around a perimeter of the container; and filling a reservoir in the base member of the container with a fluid through at least one fill port in the seal.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

The present invention relates to a wipe container or pack that is designed to hold a cleaning agent that can be easily applied to the wipe or wipes in the container with the appropriate amount of cleaning agent. In a preferred embodiment, the container is used in a clean room or facility where extreme cleanliness is a necessity. The container of the present invention is configured to isolate the wipes and the cleaning agent until needed for cleaning, thereby reducing degradation of both the wipes and the cleaning agent. This is particularly useful when the cleaning agent degrades when it is mixed with the wipes, chemicals in the wipes, or water in the wipes. By keeping the cleaning agent and the wipes separated, it is possible to maintain the effectiveness of the cleaning agent until it is ready to be used.

Figure 1:
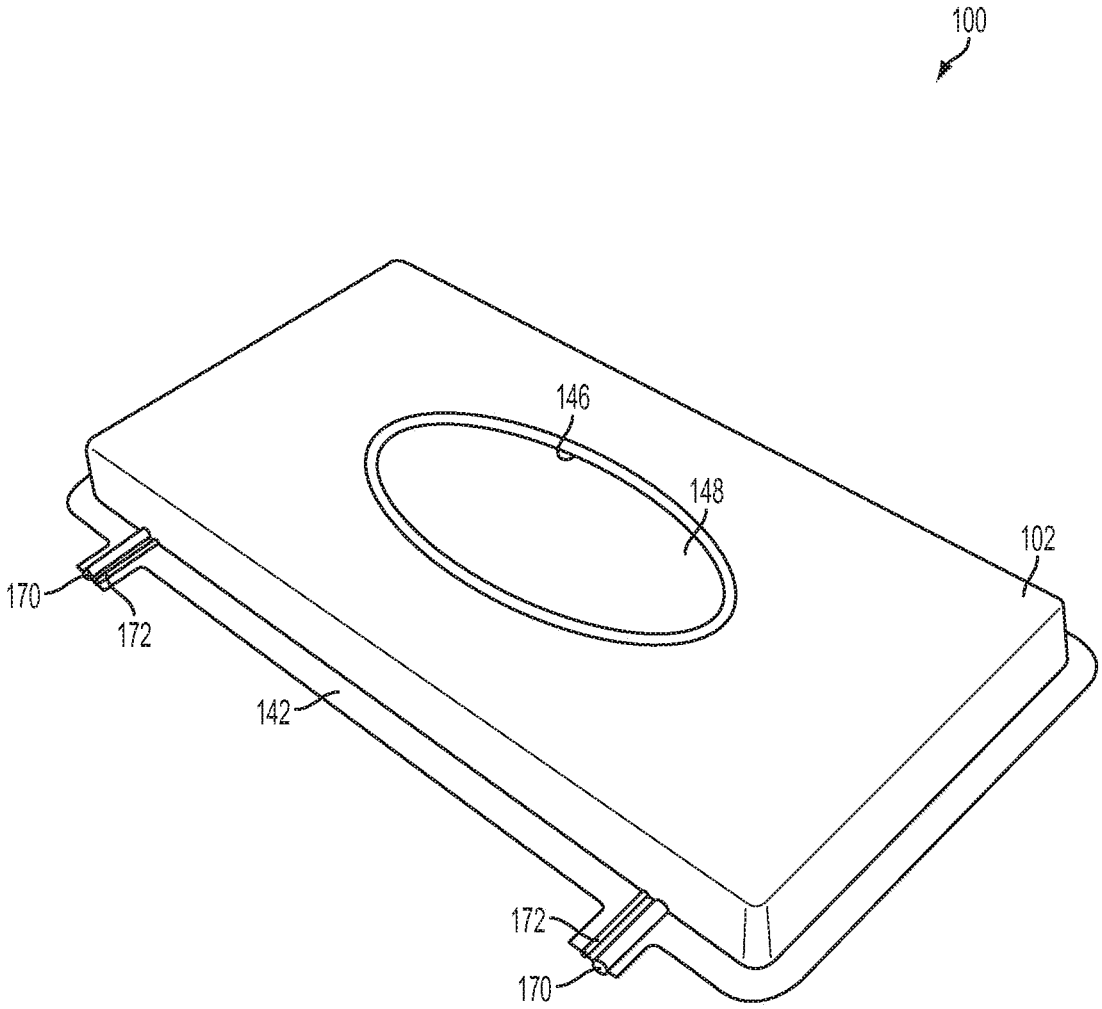
FIG. 1 is a perspective top view of a wipe container in accordance with an exemplary embodiment of the present invention.
Figure 2:
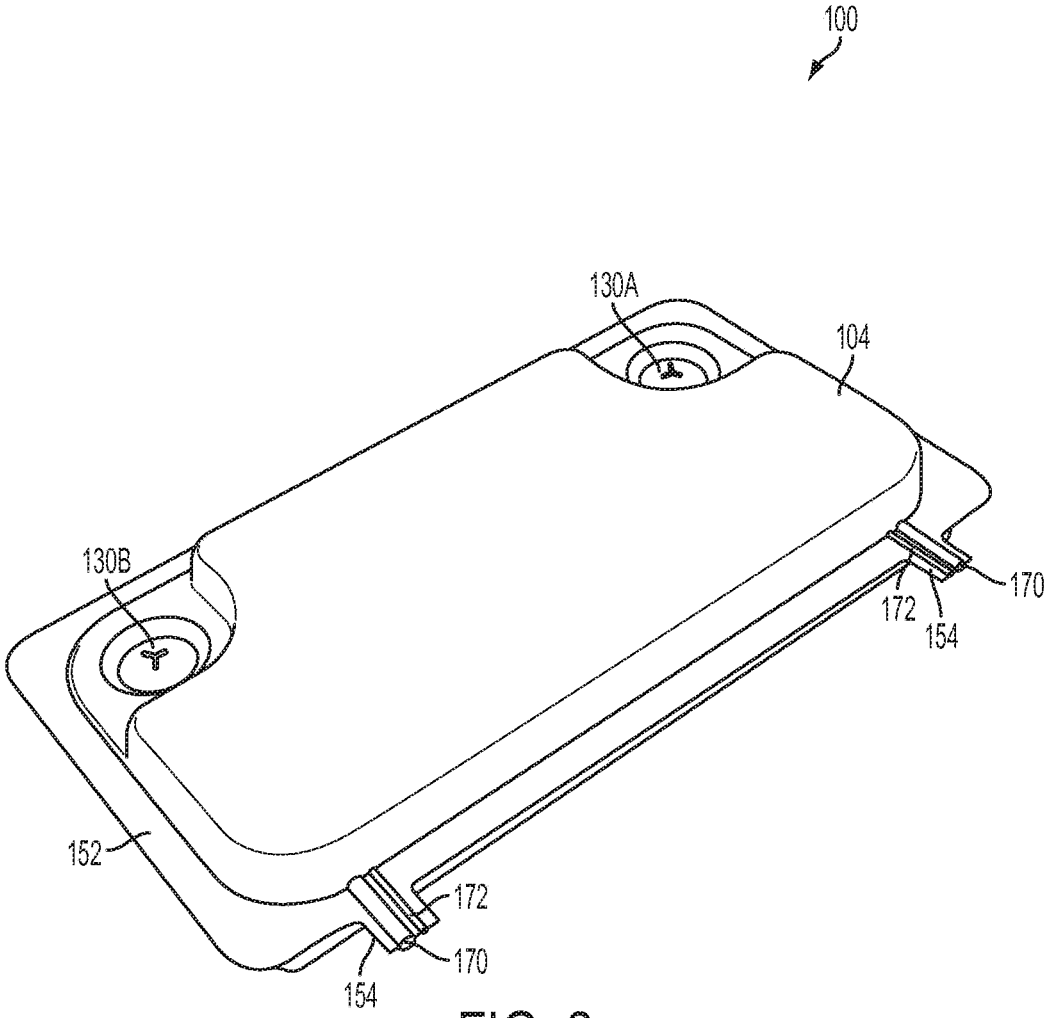
FIG. 2 is a perspective bottom view of the wipe container illustrated in FIG. 1.
Figure 3:
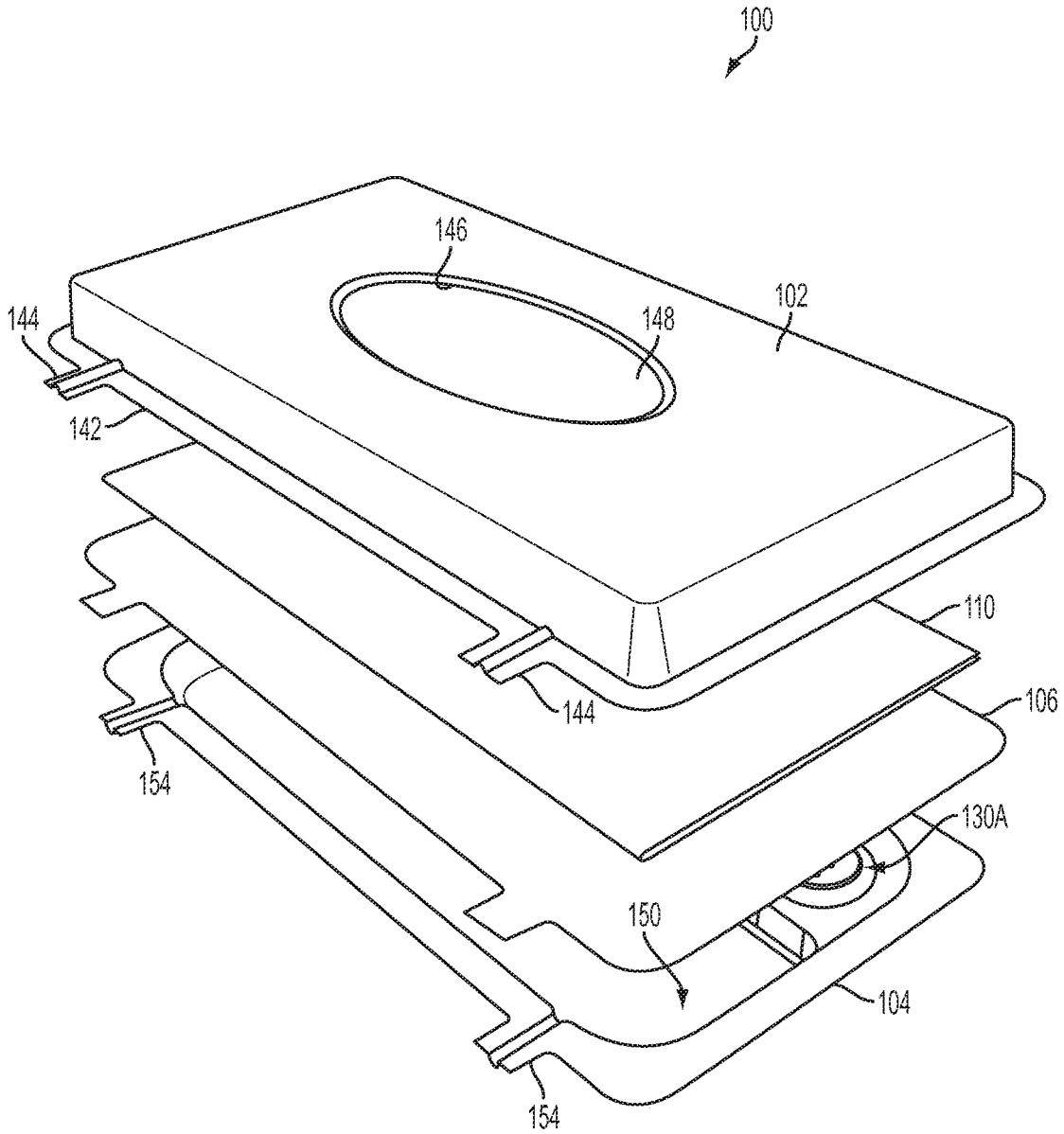
FIG. 3 is an exploded perspective view of the wipe container illustrated in FIG. 1.
Figure 5:
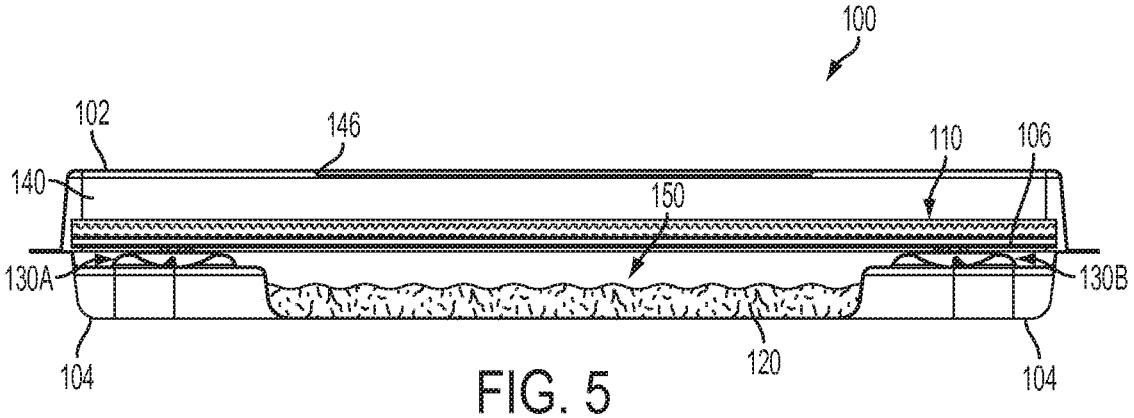
FIG. 5 is a cross-sectional view of the wipe container illustrated in FIG. 1, showing the container prior to puncture of a partition.

Referring to FIGS. 1-3, the container 100 of the present invention generally includes a cover member 102 sealed to a base member 104 and a partition 106 therebetween. The partition 106 is preferably a membrane that is fluid impregnable. The cover member 102 holds one or more wipes 110 and the base member 104 holds a cleaning agent or fluid 120 (FIG. 5). The container 100 preferably incorporates one or more puncture members 130A and 130B to split the partition 106 open (preferably along a line) when desired, thereby allowing the cleaning agent or fluid 120 to combine with the wipes 110. The opening of the partition 106 does not create any particles that might enter the fluid 120 or wipes 110 or otherwise contaminate the fluid 120 and/or wipes 110. The cover 102 and base 104 can be formed of a polypropylene (PP) or high density polyethylene (PE) material, or other suitable materials.

The cover member 102 with one or more sides and a top, defines a cavity 140 (FIG. 5), sized to hold the one or more wipes 110. The wipes 110 may be any conventional wipe suitable for cleaning surfaces, such as a cloth, polyester, nylon, or the like fabric. The wipes 110 may be dry, or treated with standard wipe chemicals, or presaturated with water to dilute the fluid 120 once mixed, or treated with chemicals to be mixed or combined with the fluid 120. A flange 142 is provided around the perimeter of the cover member 102 for sealing to the base member 104 and extends outward. One or more tabs 144 extend from at least one side of the perimeter flange 142, as seen in FIGS. 1 and 2. The cover member is preferably provided with a dispensing slot or opening 146 for retrieval and dispensing of the wipes 110. An adhesive cover sheet 148 is provided over the dispensing slot 146, which can be peeled off to dispense the wipes 110. The sheet 148 seals to the top surface of the cover member 102 about the dispensing slot or opening 146.

The base member 104 has one or more sides and a bottom, and includes a reservoir 150 (FIGS. 3 and 5), for holding the cleaning fluid 120. The cleaning fluid 120 may be any cleaning agent or solution that is suitable for cleaning contaminants, particularly contaminants found in a clean room. For example, the cleaning fluid 120 may be hydrogen peroxide, phenol, paracetic acid/hydrogen peroxide, quaternary ammonium, bleach, peroxide, surfactant based cleaners, and thiosulfate, or any chemical that has the inability to remain stable when mixed with water or a second chemical agent, or the like, though certain agents might be less suitable or require a special wiper, such as chlorine (which may bond to the wiper) and bleach (which may degrade a polyester wiper). Like the cover member 102, the base member 104 includes a perimeter flange 152 with one or more tabs 154 extending from a side thereof.

Figure 4:
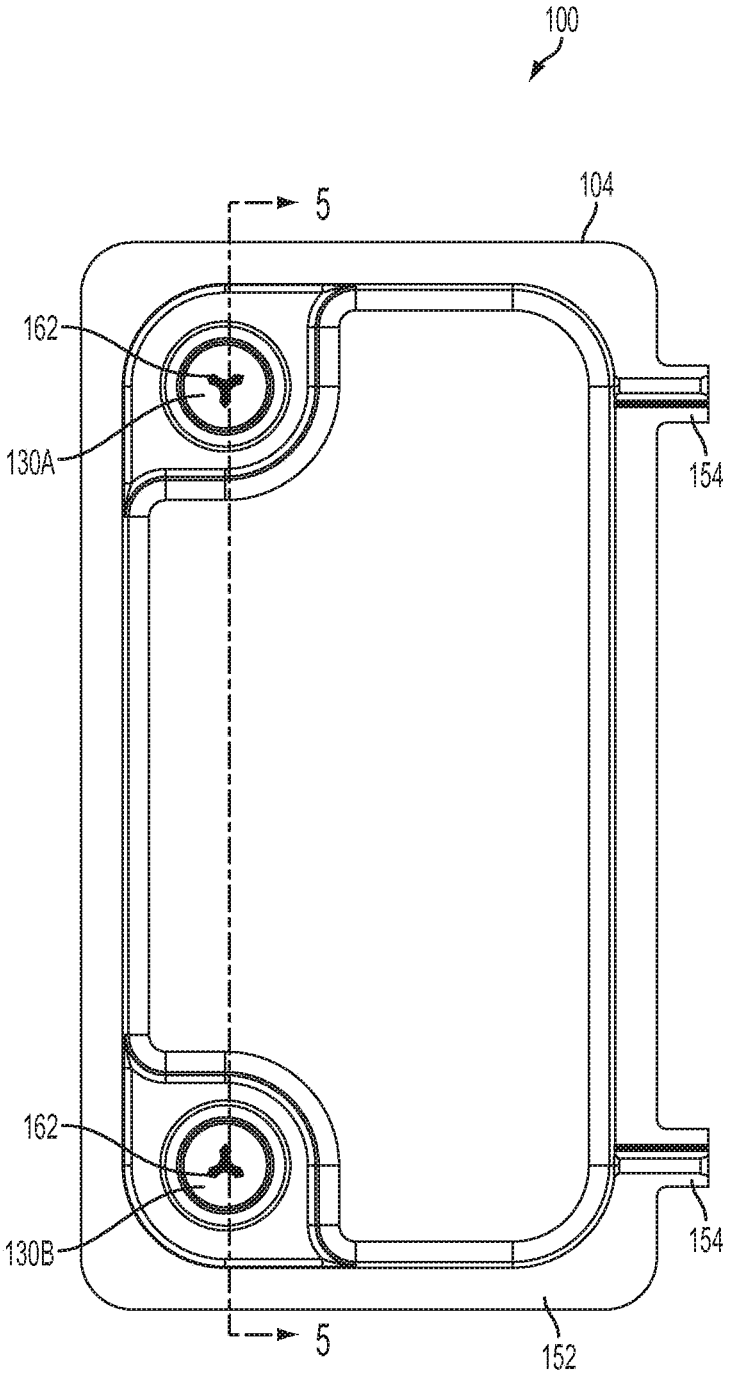
FIG. 4 is a bottom plan view of the wipe container illustrated in FIG. 1.
Figure 6:
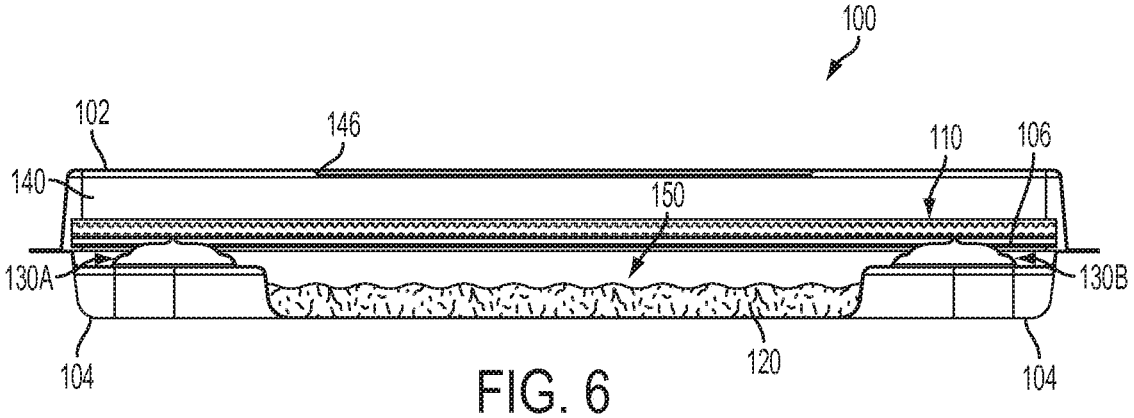
FIG. 6 is a cross-sectional view of the wipe container illustrated in FIG. 5, showing the container after puncture of a partition.

The one or more puncture members 130A and 130B are located on the base member 104 preferably between the reservoir 150 and the perimeter flange 152. As best seen in FIGS. 4 and 5, the puncture members 130A and 130B are respectively positioned near each end of the container and toward one side and adjacent to the partition 106. The puncture members 130A and 130B are inset with respect to the reservoir 150, so users can readily locate the puncture members with their fingers. Each puncture member 130A and 130B is formed of a flexible material, such as plastic, and is shaped similar to a convex dome before activation (FIG. 5). The puncture member 130 has a dome portion 132 and a puncture portion 134 located at center of the dome portion 132. The puncture portion 134 extends outward from the dome portion 132 (upward in embodiment of FIG. 5). The puncture portion 134 can be sharp or rounded. Each puncture member 130A and 130B may be activated by pushing the dome portion 132 from the base member side toward the cover member side (upward in embodiment of FIG. 5). This pushes the puncture portion 134 outward. In the ready state (FIG. 5), the dome portion 132 is inverted and the puncture portion 134 is receded; in the activated state (FIG. 6), the dome portion 132 and the puncture portion 134 are pushed outward until the puncture portion extends through and pierces the partition 106, as seen in FIG. 6.

The partition 106 is preferably taut such that the puncture members 130A and 130B slice, pierce or split open the partition 106 along the length of the container 100 for substantially the entire distance between the puncture member 130A and the second puncture member 130B, thereby allowing the fluid 120 in the reservoir 150 to enter the cavity 140 and combine with the wipes 110 and/or any water that is on the wipes 110 or in the cavity 140. By having two puncture members, the partition 106 can be split the entire length between them. The partition 106 material and the puncture members 130 do not create any particles of the partition 106 that could contaminate the fluid 120 and/or wipes 110. The user may push both puncture members 130A and 130B at the same time. A tri-legged slot 162 (FIGS. 2 and 4) is be added to each puncture portion 134 to facilitate activation and pushing through of the dome portion 132 so that puncture portion 134 can pop out. The partition 106 is preferably formed of any fluid impregnable material, such as foil, polyethylene film, polypropylene film, or the like, that can be split open, and that also resists corrosion from the cleaning fluid 120.

In one embodiment, the wipes can be treated with sodium thiosulfate and the cleaning fluid 120 is bleach. When the bleach is combined with the wipes, the sodium thiosulfate should be sufficient to bring the pH to about 1-3, and more preferably to about 2. At this pH, the bleach is a more efficient cleaning agent. Notably, however, the bleach at a 2 pH does not last very long, whereas bleach at a higher pH (such as about 11-12) has a longer shelf life (but is less effective as a cleaning agent). Thus, the invention is able to provide the bleach wipe at lower pH levels that are more effective for cleaning purposes, at a long shelf life since the bleach is not mixed with the acid until it is ready to be used.

In another embodiment, the wipes are dry or treated with water and the cleaning fluid 120 is phenol, hydrogen peroxide, or paracetic acid/hydrogen peroxide. Here, the dry or water containing wipes may contain chemicals that are used in the normal treatment of the wipes, e.g. chemicals used to soften the wipes.

To load the container 100, the wipes 110 are loaded into the cavity 140 of the cover member 102. The cover member 102, partition 106, and base member 104 are then sealed together at the perimeter thereof such that the perimeter flanges 142 and 152 and the perimeter of the partition 106 are sealed together and the corresponding tabs 144 and 154. Any sealing method may be used, such as heat sealing. The sealing step separates the reservoir 150 and the cavity 140 (by the partition 106), and extends the shelf life of the wipes and fluid. The partition 106 completely seals the cavity 140 from the reservoir 150 so that the wipe 110 (dry or pre-saturated) and the cleaning fluid 120 cannot mix and the cleaning fluid 120 cannot enter the cavity 140. The seal also defines an inside and outside of the container 100. The cavity 140, reservoir 150, wipes 110, fluid 120 (when filled), and preferably the puncture member 130, are located inside the container 100 (and perimeter seal). The ports 170 allow fluid to be introduced into (and air or fluid to be removed from, as needed) the cavity 140 and/or reservoir 150 from outside the container 100. In a preferred embodiment, the flange 142, the flange 152, and the partition 106 are aligned and sealed together simultaneously. The container is then sterilized by any known method, such as irradiation.

Following irradiation, the cleaning fluid 120 can then loaded into the container 100 through one or more fill ports 170 provided in the seal of the container 100, preferably at the tabs 144 and 154. The ports 170 may be formed by channels in the tabs. Each port 170 is an opening that extends the entire length of tab 144 and tabs 154 to allow fluid to be intruded into the cavity 140 and reservoir 150 from the outside. Thus, the ports 170 extend from inside the perimeter seal to outside the perimeter seal. In an alternative embodiment, the ports 170 can be separate tubes that are placed in the tab channels and extend into the cavity 140 and reservoir 150. The ports 170 enable a fluid to be introduced into the cavity 140 and/or reservoir 150 (which are inside the perimeter seal and the container) from an external source located outside the perimeter seal and container. The cleaning fluid 120 is preferably aseptically filled into the reservoir 150 through the ports 170. For instance, a fluid filter may be provided, such as 0.22 micron filter, to remove particulates and bacteria and spores greater in size in the chemical composition, and then the fluid 120 is filled into reservoir 150. The container can be filled through one of the ports 170 and vented through another.

Once the reservoir 150 is filled with the precise amount of cleaning fluid 120 for the wipes 110, the fill ports 170 are closed and sealed. If the wipes 110 are to be saturated with water or if water (or other diluents or chemicals) are to be placed into the cavity 140 with the wipes 110, that can be done at the same time or before/after the fluid 120 is filled into the reservoir 150 through one of the ports 170. For instance, one port 170 can lead into the cavity 140 and one port 170 can lead into the reservoir 150; or, the ports 170 can each lead to the cavity 140 and reservoir 150, separated by the partition 106. Or, the water can be placed into the cavity 140 at the same time the wipes 110 are loaded into the cavity 140.

In one embodiment, a closure valve or connector can be placed at the end of the ports 170 to operate as a closure. In this manner, the connectors can be opened and closed to open/close the ports 170. The cavity 140 and reservoir 150 can be filled before or after irradiation. The ports 170 can be closed at all times, except when being used to fill the cavity 140 and reservoir 150. The two halves can be formed, then tubular ports 170 placed in each half, the wipers inserted, and the membrane stretched between the two halves (i.e., placed between the two halves tightly (not loosely) so the piercing devices can cut it or otherwise create a hole or slit), and the entire package sealed together. Alternatively, the membrane and one port can be partially sealed together to create the chemical halve and the wipes placed into the other halve, which is then brought together and sealed. Once the package is fully assembled, the liquids can be filled into the cavity 140 and reservoir 150 simultaneously or sequentially, either before or after irradiation. Once the fluid is filled into the cavity 140 and reservoir, the connector can be closed or removed and the port 170 sealed closed. Any suitable connector can be utilized, such as the SPS 4 offered by IPN.

The container 100 can be sterilized either before or after the fluid 120 is loaded. If the cleaning fluid 120 can be irradiated, then the fluid 120 is loaded, heat sealed and irradiated. If the cleaning fluid 120 cannot be irradiated, then the container 100 is irradiated and then aseptically filled following irradiation.

In operation, the assembled container 100 is ready for use. The container 100 can be double-bagged in polypropylene bags and heat sealed so that they can be introduced into a controlled environment. The puncture members 130A and 130B are in the ready state. To use the container 100 and the wipes 110, the puncture members 130 are activated by the user pushing them from outside the base member 104 through the partition 106 to allow the wipes 110 to be saturated by the cleaning fluid 120. It is preferable that the wipes 110 and the fluid 120 sit for a period of time, such as five minutes, to allow the cleaning fluid 120 to completely saturate the wipes 110 (and mix with any water in the cavity) without dry spots on the wipes. Once saturated with the fluid 120, the wipes 110 are ready for use and may be dispensed through the opening 146 in the cover member 102 after removing the adhesive sheet 148. The container is safe to bring into or have in a clean room. The container 100 can be punctured inside the clean room and is ready to use without having to manually mix any fluid or saturate the wipes inside the clean room.

The container may be doubled bagged before bringing the container into the clean room, as described in U.S. Pat. No. 6,123,900 to Vellutato, herein incorporated by reference, thereby extending the life of the cleaning agent. That is the container can be encased in a first sealing layer, forming a first enclosure, and the first enclosure can be encases in a second sealing layer, forming a second enclosure. Both the first and second sealing layers provide for hermetic sealing.

Figure 7A:
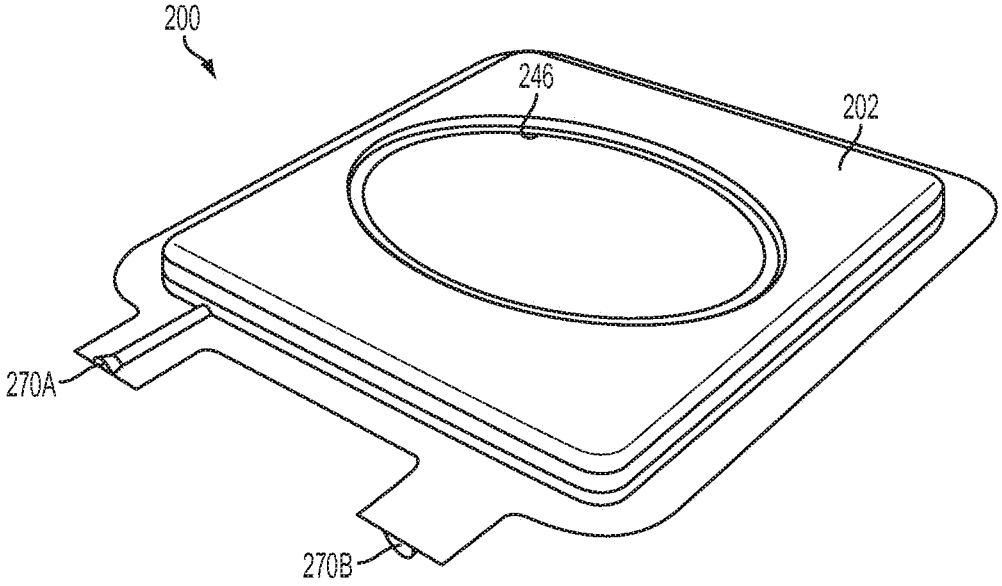
FIG. 7A is a perspective top view of a wipe container in accordance with an alternative embodiment of the present invention.
Figure 7B:
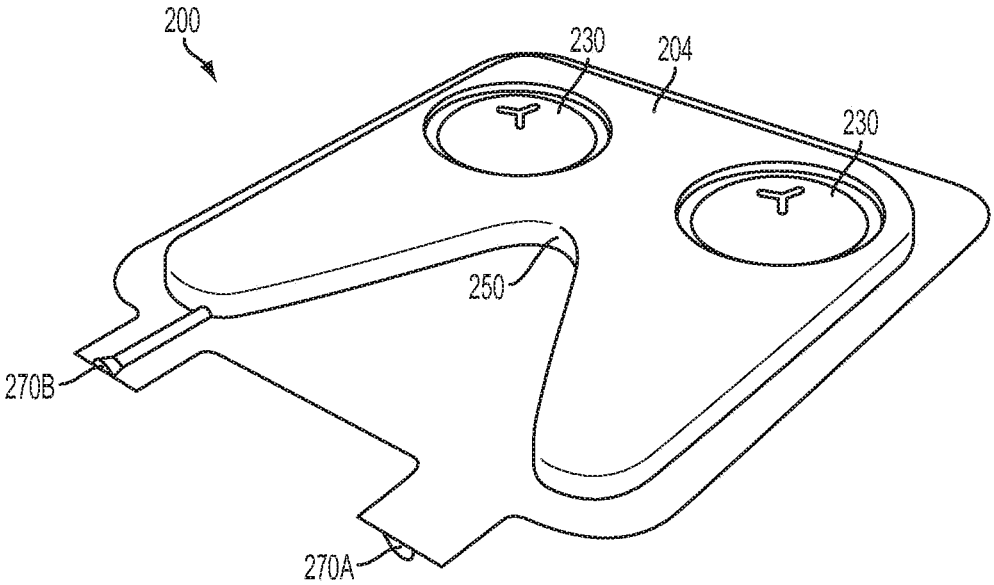
FIG. 7B is a perspective bottom view of the wipe container illustrated in FIG. 7A.

FIGS. 7A and 7B illustrate an alternative embodiment of the present invention. The container 200 of FIGS. 7A and 7B is similar to the container 100, except that the container 200 holds only a single wipe. Like the first embodiment, the container 200 includes a cover member 202 with a dispensing opening 246 for the wipes and a base member 204 with a reservoir 250 for the cleaning fluid. The base member 204 includes one or more puncture members 230 similar to the puncture members 106 of the first embodiment for slicing open a partition between the cover and the base members 202 and 204. One or more fluid ports 270A and 270B may be provided in the perimeter seal of the container 200 like the container 100 of the first embodiment. Once the port 270A communicates with and allows first fluid (such as water) to be filled into the cover cavity and other port 270B communicates only with and allows second fluid (such as a cleaning chemical composition) to be filled into the reservoir.

It is noted that the invention has been described as for use in a controlled environment such as a clean room. However, the invention need not be used in a controlled environment and need not be packaged (bagged) for use in a controlled environment. For instance, the invention can be utilized for bleach as the cleaning fluid 120 and an acid provided on or with the wipe so that bleach retains its effectiveness and the acid lowers the pH of the bleach just prior to use so that the bleach is more effective as a cleaning agent.

In addition, while a port 170 is shown and described as leading into each of the cavity 140 and the reservoir 150, one or both ports 170 need not be provided. For instance, a fluid 120 can be filled in the cavity 140 and/or the reservoir 150 before it is sealed, so that a port is not needed. Still further, while the puncture member is shown and described, other suitable configurations can be provided. For instance, the puncture member need not be positioned on the base member 104, and other suitable puncturing or slicing devices can be utilized.

In addition, while the container is shown and described as having a base member, the base member can be a separate container that is in fluid communication with the cover. Accordingly, the invention can have two containers, one that retains the wipes (with or without water) and one that retains the cleaning fluid. A fluid-impermeable partition is provided between the two containers and split by the user actuating a puncture member to allow fluid to pass between the two containers.

While particular embodiments have been chosen to illustrate the invention, it will be understood by those skilled in the art that various changes and modifications can be made therein without departing from the scope of the invention as defined in the appended claims.

What is claimed is:

1. A method of loading a wipe container, comprising the steps of:

providing a container having a cover member, a base member, and a partition, the partition being a fluid impregnable membrane;

loading at least one wipe into a cavity of the cover member of the container;

sealing the partition between the cover member and the base member at a perimeter of each of the partition, cover member, and base member, thereby creating a seal around a perimeter of the container; and filling an empty reservoir in the base member of the container with a fluid through at least one fill port in the seal.

2. The method of claim 1, further comprising the step of sterilizing the container.

3. The method of claim 1, further comprising the step of sealing the fill port.

4. The method of claim 1, wherein the step of filling the reservoir includes aseptically filling the reservoir with the fluid.

5. The method of claim 4, wherein the fluid is a cleaning fluid.

6. The method of claim 1, further comprising the step of the step of sealing the cover and base members includes heat sealing the cover and base members.

7. The method of claim 1, further comprising the step of pre-saturating the at least one wipe.

8. A method of loading a wipe container, comprising the steps of:

loading one or more wipes into a cavity of a cover member of the container;

sealing a fluid impregnable membrane between the cover member and a base member of the container at a perimeter of each of the fluid impregnable member, the cover member, and the base member, thereby creating a seal around a perimeter of the container; and filling an empty reservoir in the base member of the container with a fluid, wherein the perimeters of the cover member, the base member, and the fluid impregnable membrane are sealed together at the same time and prior to filing the empty reservoir with the fluid.

9. The method of claim 8, further comprising the step of sterilizing the container after the fluid is filled in the reservoir of the base member of the container.

10. The method of claim 8, further comprising the step of sterilizing the container prior to filling the reservoir of the base member of the container.

11. The method of claim 8, wherein the step of filling the reservoir in the base member of the container with the fluid includes filing the reservoir with the fluid through a fill port provided in the seal.

12. The method of claim 8, wherein the fluid is cleaning fluid, the base member includes a puncture member configured to puncture the fluid impregnable membrane, and the cover member includes an opening for dispensing the one or more wipes.

* * * * *